US006439470B1

(12) United States Patent
Hull

(10) Patent No.: US 6,439,470 B1
(45) Date of Patent: Aug. 27, 2002

(54) PREFABRICATED EMBEDDED RAILWAY TRACK SYSTEM WITH REMOVABLE INSERTS

(76) Inventor: William K. Hull, P.O. Box 8137, Ennis, TX (US) 75120

( * ) Notice: Subject to any disclaimer, the term of this patent is extended or adjusted under 35 U.S.C. 154(b) by 0 days.

(21) Appl. No.: 09/454,392

(22) Filed: Dec. 3, 1999

(51) Int. Cl.[7] ..... E01B 1/00
(52) U.S. Cl. ..... 238/8
(58) Field of Search ..... 238/2, 5, 8

(56) References Cited

U.S. PATENT DOCUMENTS

| | | | | | |
|---|---|---|---|---|---|
| 2,950,057 | A | | 8/1960 | Speer | 238/8 |
| 4,236,670 | A | | 12/1980 | Limmergard et al. | 238/8 |
| 4,415,120 | A | | 11/1983 | Thim | 238/8 |
| 5,181,657 | A | * | 1/1993 | Davis | 238/8 |
| 5,464,152 | A | | 11/1995 | Wabnitz | 238/8 |
| 5,465,903 | A | | 11/1995 | Davis et al. | 238/8 |
| 5,535,947 | A | | 7/1996 | Hogue et al. | 238/2 |
| 5,535,948 | A | | 7/1996 | Williams | 238/8 |
| 5,538,182 | A | * | 7/1996 | Davis et al. | 238/8 |
| 5,609,294 | A | | 3/1997 | Lucas, Jr. | 238/9 |
| 5,622,312 | A | | 4/1997 | Martin | 238/2 |
| 5,655,711 | A | | 8/1997 | Hull et al. | 238/8 |
| 5,740,961 | A | * | 4/1998 | Bruning | 238/8 |
| 5,813,602 | A | | 9/1998 | Holland | 238/8 |
| 5,850,970 | A | | 12/1998 | Hull et al. | 238/8 |
| 6,079,630 | A | * | 6/2000 | Schroeder | 238/8 |

* cited by examiner

*Primary Examiner*—S. Joseph Morano
*Assistant Examiner*—Robert J. McCarry, Jr.
(74) *Attorney, Agent, or Firm*—Rudolf O. Siegesmond

(57) ABSTRACT

An embedded railway system comprising at least one insert removably affixed to a surrounding surface such as a concrete panel by one or more securement devices so that the insert can be installed, removed, replaced or reinstalled without the need to remove the panel.

16 Claims, 8 Drawing Sheets

( VIEW 6-6 )

PREFABRICATED EMBEDDED RAILWAY TRACK SYSTEM WITH REMOVABLE INSERTS

FIELD OF THE INVENTION

The present invention relates to railway track assemblies and more particularly to an apparatus and method for embedding railway tracks at crossing sites.

BACKGROUND OF THE INVENTION

Railway track assemblies typically employ a pair of steel rails supported by a plurality of perpendicularly disposed ties that rest on a ballast material. Where roadways intersect or coincide with railway tracks, it is necessary for non-rail vehicles to cross over the railway track assemblies. Often it is desirous to embed the railway tracks so that the top surface of the rails is substantially the same height as the finish grade of the surrounding surface. Embedding the rails in the surrounding surface allows the non-rail vehicles to pass over the rails without discomfort to the non-rail vehicle occupants, damage to the non-rail vehicles, or damage to the track structure.

Each pair of rails forming a track have inner sides which are called "gauge" sides. The "gauge" sides face each other. The outer sides of the pair of rails forming a track are called "field" sides. The rails may be embedded in a surrounding surface on the "gauge" side and the "field" side. One of the more common surrounding surfaces is a concrete panel. When rails are embedded in a surrounding surface such as concrete panels, gaps must exist between the rail and the surrounding surface. The gaps between the rails and the surrounding surface or panels allow the wheels of the rail-guided vehicle to pass without obstruction and prevent the surrounding surface from contacting and moving the rails into an unusable out-of-alignment position.

The gap between the rail and the surrounding surface causes problems such as the accumulation and flow of fluids and foreign objects between the rail and the surrounding surface. These fluids and foreign objects can damage railway crossing system components, such as ballast, ties, and the attaching hardware. Another problem is that when the surrounding surface is moveable, the gap can allow the surrounding surface or panel to contact or move too close to the rails. In particular, when the center panels of the embedded railway track assemblies are not fixedly attached to the railway ties, the center panels can contact or move too close to the rails.

The gap between the rail and the surrounding surface or panels may be filled with material such as asphalt, timber, or an elastomeric material such as natural or synthetic rubber. Such fillers may be attached or not attached to the surrounding surface or panel. One problem with such fillers is that they can be difficult to install, remove, reinstall or replace during, for example, track and ballast inspection and maintenance. A problem with unattached fillers is that they can shift rotationally, laterally, or longitudinally out of their correct installation position during use. A particular problem with existing attached fillers is that they can not be removed, reinstalled or replaced without also moving or removing the surrounding surface or panel. Another problem with attached fillers is that it may be necessary to replace the surrounding surface or panel when the attached filler is replaced.

The passage of non-rail vehicles over the embedded railway track assemblies and the exposure to the elements and caustic fluids and foreign objects causes a deteriorating effect on the embedded railway track assemblies. It therefore is desirable to construct the embedded railway track assemblies out of durable materials.

For the foregoing reasons, there is a need for durable embedded railway track systems that reduce the flow of fluids and other foreign objects between the rail and the surrounding surface, that prevent a moveable surrounding surface from contacting or moving too close to the rails, that are removably attached to the surrounding surface, and that are easy to install, remove, reinstall and replace without moving or removing the surrounding surface.

U.S. Pat. No. 5,850,970 to Hull (the present inventor) discloses an elastomeric insert supported by a bracket and affixed to the panel by reinforcing member. The insert is not removable from the panel.

U.S. Pat. No. 5,813,602 to Holland discloses an elastomeric insert affixed to the panel by an edge protector, an extension welded to the edge protector and a bolt inserted through the insert and extension secured by a nut (FIG. 5). The patent does not teach or suggest that the insert is intended to be removable without moving or removing the surrounding surface or panel. The position of the securing nut shows that it would be necessary to move the panel in order to access the bolts and the insert would have to be installed on the panel prior to placement of the panel. The position of the securing nut further shows that the panel would have to be moved in order to access the bolt and nut for removal of the insert.

U.S. Pat. No. 5,655,711 to Hull (the present inventor) discloses an elastomeric insert supported by a bracket and affixed to the panel an embedded reinforcing member.

U.S. Pat. No. 5,538,182 discloses an elastomeric insert affixed to the panel by a gripping member embedded in the insert and a cavity for receiving the gripping member where the insert is affixed to the panel by the frictional engagement of the gripping member and the cavity. Once engaged the insert cannot be removed from the panel.

U.S. Pat. No. 5,465,903 to Davis discloses an embedded system in which both field and gauge inserts are bolted to an anchor plate. The '903 patent does not have a panel; rather, the entire system is made of elastomeric material both between the tracks and between the outside of the tracks and the roadway.

U.S. Pat. No. 4,415,120 to Thim discloses rubber inserts which are secured to the panels by screws. The '120 patent does not teach removing the rubber inserts for any reason.

U.S. Pat. No. 4,236,670 discloses inserts secured to the panel by means of expanding bolts.

U.S. Pat. No. 2,950,057 to Speer discloses elastomeric inserts secured by a support plate and bolts welded to a plate, and a nut and washer affixed to the bolt after the elastomeric insert is positioned. The drawings indicate that once installed, only the bolts at the very ends of the system would be accessible, if at all. The '057 patent does not teach or suggest that the insert would be removable without the need to move the panel to which the insert is attached. The "U" shaped design of the insert does not allow for access to the bolts once installed. Moreover, the '057 patent teaches away from removability by stating "[b]efore putting the rubber strip into place one side can be coated with a suitable rubber cement to provide an adhesive bond between the rubber strip 16 and plate 20" (Col 3, 1. 15–18).

Therefore, the prior art does not disclose durable embedded railway track systems that reduce the flow of fluids and other foreign objects between the rail and the surrounding surface, that prevent a moveable surrounding surface from contacting or moving too close to the rails, that are removably attached to the surrounding surface, and that are easy to install, remove, reinstall and replace without moving or removing the surrounding surface.

SUMMARY OF THE INVENTION

The present invention which meets the needs identified above is an embedded railway system comprising one or more inserts removably affixed to a surrounding surface such as a concrete panel by one or more securement devices such as a bolt and a nut so that the inserts can be installed, removed, replaced or reinstalled without the need to move the surrounding surface.

The foregoing and other features and advantages of the invention will be apparent from the following more particular description of a preferred embodiment of the invention, as illustrated in the accompanying drawings wherein like reference numbers represent like parts of the invention.

DETAILED DESCRIPTION OF THE PREFERRED EMBODIMENT

Figure 1:
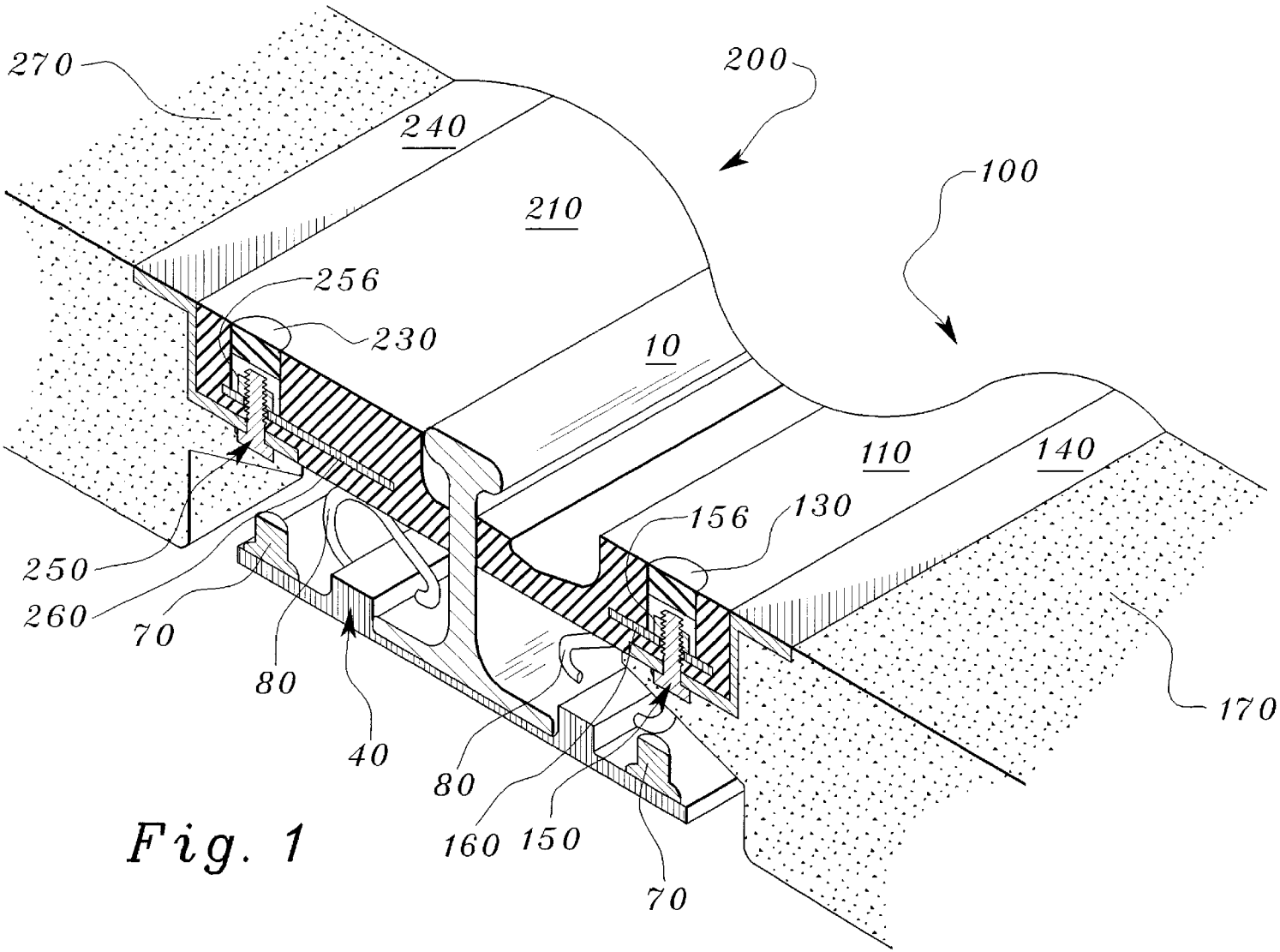
FIG. 1 depicts an overview of the system for one rail.

FIG. 1 shows the overall system as it is applied to one rail. Rail 10 is fastened to tie plate 40 by means of rail clips 80. Tie plate 40 is secured to a railroad tie (not shown) by spikes 70 or other rail fasteners. Persons skilled in the art are familiar with a variety of ways to secure rails to ties or other rail foundations such as concrete ties, plastic ties, cross ties or slabs. Gauge panel 170 and gauge insert 110 together make up gauge component 100 of the system. The cross sectional view reveals gauge bolt 150, gauge nut 156, gauge cap 130 and gauge plate 160. Gauge angle 140 is attached to gauge panel 170 and gauge insert 110 is attached to gauge panel 170 by gauge angle 140, gauge bolt 150 and gauge nut 156. As used herein for all purposes and references, the word "bolt" shall have the same meaning as the term "securement device" and said term shall include all equivalents to "bolt" known to persons skilled in the art. As used herein for all purposes and references, the word "nut" shall have the same meaning as the term "securement device cap" and said term shall include all equivalents to "nut" known to persons skilled in the art.

On the other side of rail 10, field component 200 is made up of field panel 270 and field insert 210. Field angle 240 is attached to field panel 270 and field insert 210 is attached to field panel 270 by field angle 240, field bolt 250, field plate 260 and field nut 256.

Figure 2:
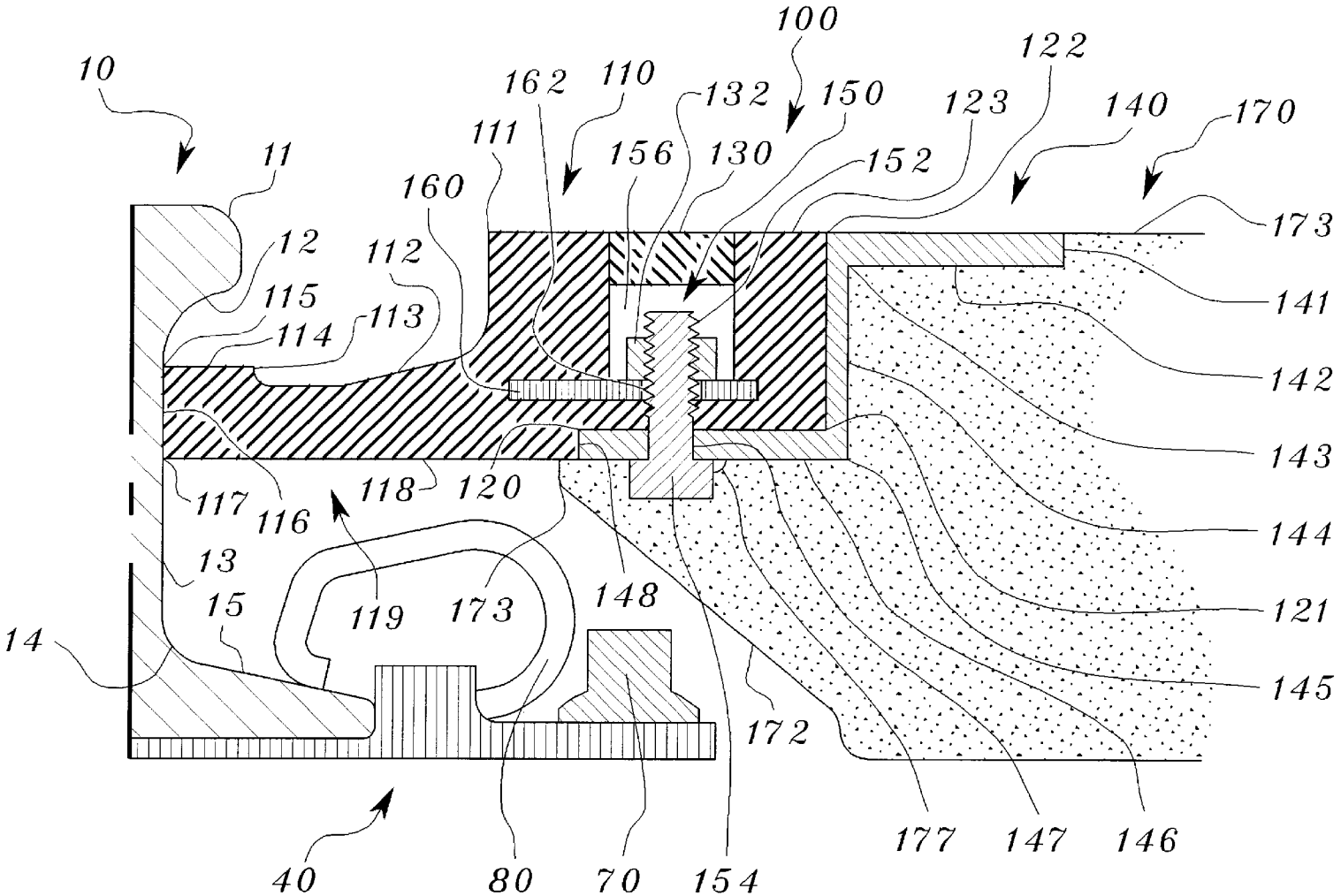
FIG. 2 depicts a cross section of the gauge side of the system for one rail.

FIG. 2 shows a view of the cross section of gauge component 100. Gauge angle 140 is a metal piece anchored to gauge panel 170 by anchor rods (not shown) secured to gauge angle 140 and to rebar rods (not shown) which run through gauge panel 170. In the preferred embodiment, the anchor rods are secured to gauge angle 140 and to rebar rods in gauge panel 170 by welding. Persons skilled in the art are familiar with a variety of methods and devices for securing anchor rods to metal plates such as gauge angle 140 and also for securing anchor rods to rebar rods embedded in concrete. Gauge angle 140 has gauge angle top horizontal section 142, gauge angle bottom horizontal section 146 and gauge angle vertical section 144. Gauge angle top horizontal section 142 fits in an indent in gauge panel 170 so that the top surface of gauge angle top horizontal section 142 is generally flush with the top surface of gauge panel 170. Gauge angle bottom horizontal section 146 has gauge angle hole 147 for receiving gauge bolt 150. In the preferred embodiment, gauge bolt 150 is inserted into gauge angle hole 147 in gauge angle bottom horizontal section 146 and is welded in place so that gauge bolt threaded body 152 extends upward perpendicular to the surface of gauge angle bottom horizontal section 146. Gauge bolt base 154 is embedded in the material of gauge panel 170. Gauge bolt base 154 may be further secured by weld 177. In the preferred embodiment the material of gauge panel 170 is concrete. Persons of ordinary skill in the art will know that use of gauge bolts 150 could be reversed so that gauge bolt base 154 could be turned to thread gauge bolt threaded body 152 into a threaded cavity in gauge angle bottom horizontal section 146 or to gauge nut 132 welded to the bottom of gauge angle bottom horizontal section 146.

Gauge insert 110 is shaped to receive gauge angle bottom horizontal section 146 and has gauge insert access hole 156. Gauge insert 110 has gauge plate 160 embedded inside the material of gauge insert 110. Gauge plate 160 has gauge plate hole 162 for receiving gauge bolt 150. Gauge plate 160 rests inside and on the material of gauge insert 110 below gauge plate 160. Gauge insert 110 is placed on gauge panel 170 so that gauge bolt 150 extends through gauge plate hole 162 and into gauge insert access hole 156. Gauge nut 132 is rotated on gauge bolt 150 and tightened until gauge insert 110 is brought into position against both gauge angle vertical section 144 and gauge angle bottom horizontal section 146. When gauge insert 110 is brought into position against both gauge angle vertical section 144 and gauge angle bottom horizontal section 146, gauge insert 110 is fixedly and removably attached to gauge panel 170 so that no lateral or vertical movement of gauge insert 110 can take place relative to gauge panel 170. In the preferred embodiment, gauge bolt 150 is a ⅝" outside diameter threaded bolt. Persons skilled in the art will recognize a variety of securement devices in addition to threaded bolts which can be used. For example, a very inexpensive option would be to force fit a mushroom cap (acting as the nut) onto the end of a rebar rod (acting as the bolt) to accomplish the same end. Another option would be to employ a releaseable pressure device to grip a rebar rod or a bolt. In the preferred embodiment, gauge insert 110 is made of a durable, flexible and resilient elastomeric material. Molded natural rubber is one suitable material meeting the requirements. Molded synthetic rubber is another material meeting the requirements. Persons skilled in the art will be familiar with additional materials meeting the requirements described above. The securement device is accessible without the need to move the panel and therefore, the insert can be installed, removed, reinstalled or replaced without the need to move the panel.

Gauge insert 110 has gauge insert access hole cap 130 which is placed into gauge insert access hole 156 after gauge bolt 150 and gauge nut 132 have been properly tightened. Gauge insert top surface 123 is horizontal and level with gauge panel top surface 173.

Gauge insert top surface 123 ends at gauge insert top surface edge 111 and extends downward into gauge insert flangeway 112, gauge insert nose 114 and gauge insert nose rear edge 113. Gauge insert nose forward edge 115 preferably contacts rail 10 but does not necessarily contact rail 10 due to track structural tolerances. Although preferred, contact of gauge insert nose forward edge 115 is not necessary to perform a function for which gauge insert 110 is intended. A purpose of gauge insert 110 is to reduce the migration of liquid or solid materials to the rail base area of the clips, ties and ballast, and in certain applications, to stabilize gauge panel 170 movement toward rail 10. Gauge insert face 116 preferably contacts rail 10 but may not contact rail 10. Although preferred, contact is not necessary because contact need only occur if gauge panel 170 moves toward rail 10. As long as gauge insert face 116 extends under the ball of rail 10, gauge insert 110 will form a shield protecting the track and ballast below. Gauge insert bottom surface 118 is flat. FIG. 2 depicts an indent in gauge insert 110 for receiving gauge angle 140. However, the indent is not necessary and gauge insert 110 can be shaped to extend straight out from gauge angle 140. Gauge insert flangeway 112, gauge insert nose 114, gauge insert face 116 and gauge insert bottom surface 118 extend outward from gauge panel 170 toward rail 10 and define gauge insert arm 119.

Figure 3:
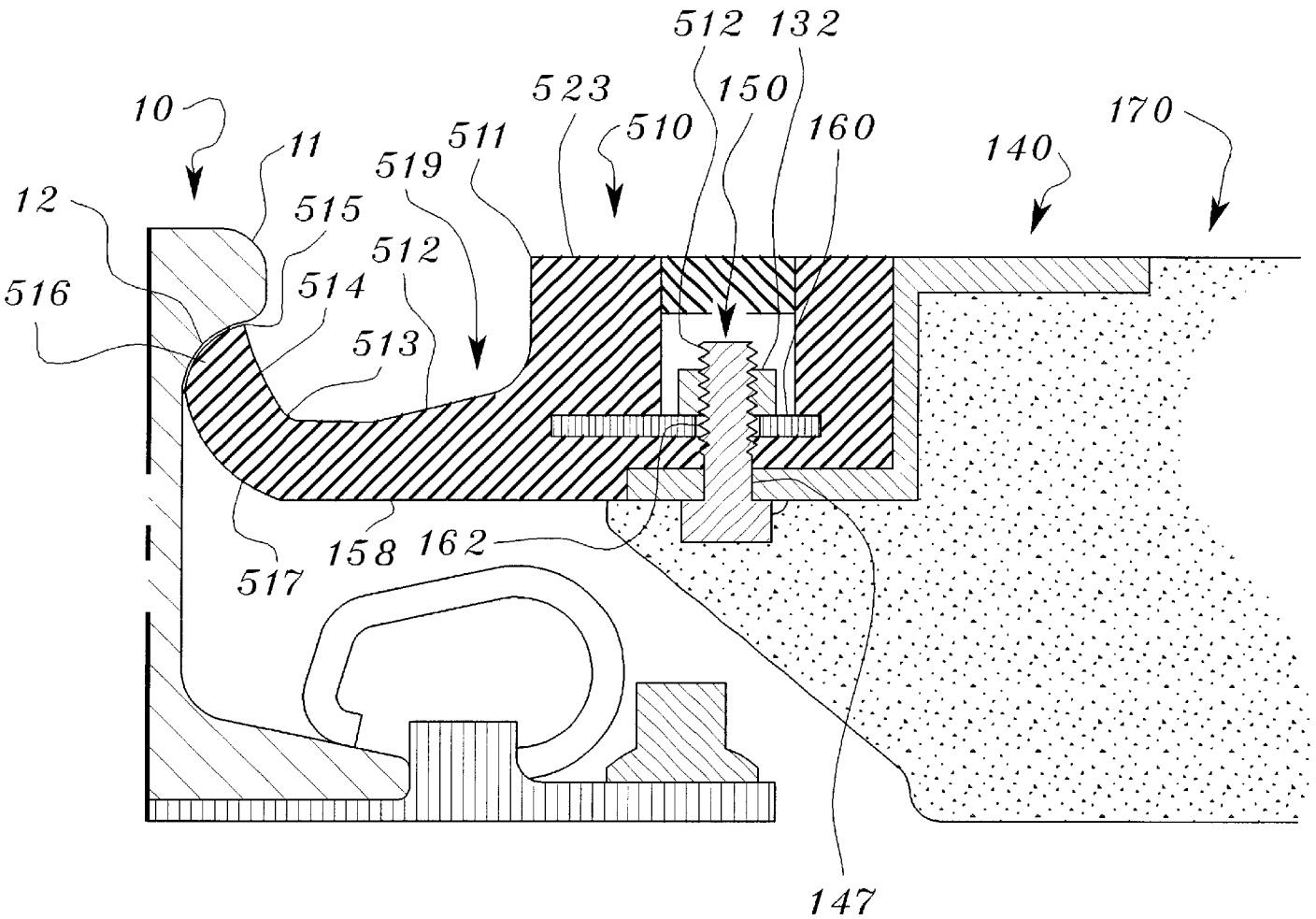
FIG. 3 depicts an alternate embodiment of the gauge insert.

FIG. 3 depicts an alternative gauge insert 510. All of the other components in FIG. 3 are the same as in FIG. 1. For example, gauge panel 170, gauge angle 140, gauge angle hole 147, gauge plate 160, and gauge nut 160 are all the same as in FIG. 2. Alternative gauge insert top surface 523 ends at alternative gauge insert top surface edge 511 and extends into alternative gauge insert flangeway 512. Alternative gauge insert flangeway 512 turns upward at alternate gauge nose start 513, continues through alternative gauge insert nose rear face 514 to alternative gauge insert nose tip 515. From alternative gauge insert nose tip 515, alternative gauge insert nose face 516 extends to alternative gauge insert nose end 517. Alternative gauge insert nose face 516 preferably contacts rail 10 but does not necessarily contact rail 10 due to rail structural tolerances. Although preferred, contact with rail 10 is not necessary to perform a function for which gauge insert 510 is intended. The purpose of gauge insert 510 is to reduce the migration of liquid or solid materials to the rail base area of the clips, ties and ballast, and in certain applications, to stabilize gauge panel 170 movement toward rail 10. Alternative gauge insert face 516 is a curved surface which may or may not contact rail 10 because, although preferred, contact need only occur if field panel 170 moves toward rail 10. As long as alternative gauge insert face 516 extends under the ball of rail 10, alternate gauge insert 510 will form a shield protecting the track and ballast below. Alternative gauge insert bottom surface 518 is generally flat. FIG. 3 depicts an indent in gauge insert 510 for receiving gauge angle 140. However, the indent is not necessary and gauge insert 510 can be shaped to extend straight out from gauge angle 140.

Alternative gauge insert top surface 523, alternative gauge insert top surface edge 511, alternative gauge insert flangeway 512, alternative gauge nose start 513, alternative gauge insert nose rear face 514, alternative gauge insert nose tip 515, alternative gauge insert nose face 516, alternative gauge insert nose end 517 and alternative gauge insert bottom surface 518 define alternative gauge insert arm 519.

Figure 4:
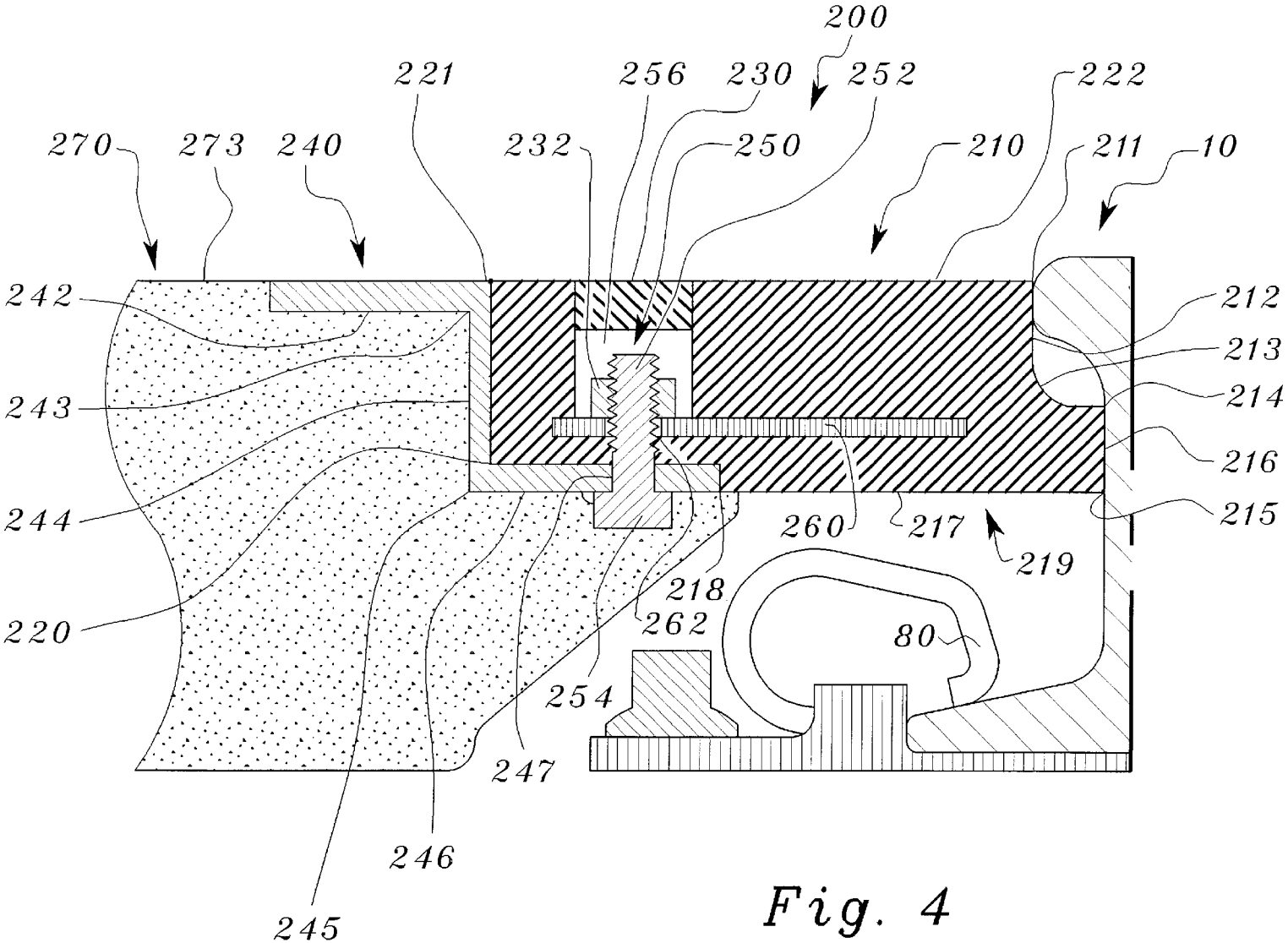
FIG. 4 depicts a cross section of the field side of the system for one rail.

FIG. 4 shows a view of the cross section of field component 200. Field angle 240 is a metal piece anchored to field panel 270 by anchor rods (not shown) welded to field angle 240 and to rebar rods (not shown) which run through field panel 270. Field angle 240 has a field angle top horizontal section 242, a field angle bottom horizontal section 246 and a field angle vertical section 244. Field angle top horizontal section 242 fits in an indent in field panel 270 so that the top surface of field angle top horizontal section 242 is generally flush with the top surface of field panel 270. Field angle bottom horizontal section 246 has hole 247 for receiving field bolt 250. In the preferred embodiment, field bolt 250 is inserted into field angle hole 247 and is welded in place so that field bolt threaded body 252 extends upward perpendicular to field angle bottom horizontal section 246. Field bolt base 254 is embedded in the material of field panel 270. In the preferred embodiment the material of field panel 270 is concrete.

Field insert 210 is shaped to receive field angle bottom horizontal section 246 and has field insert access hole 256. Field insert 210 has field plate 260 embedded inside the material of field insert 210. Field insert 210 has field plate hole 262 for receiving field bolt 250. Field plate 260 rests inside and on the material of field insert 210 below field plate 260. Field insert 210 is placed on field panel 270 so that field bolt 250 extends through field plate hole 262 and into insert access hole 256. Field nut 232 is rotated on field bolt 250 and tightened until field insert 210 is brought into position against both field angle vertical section 244 and field angle bottom horizontal section 246. When field insert 210 is brought into position adjacent to both field angle vertical section 244 and field angle bottom horizontal section 246, field insert 210 is fixedly and removably attached to field panel 270 so that no lateral or vertical movement of field insert 210 can take place relative to field panel 270. In the preferred embodiment, field bolt 250 is a ⅝" outside diameter threaded bolt. Persons skilled in the art will recognize a variety of securement devices in addition to threaded bolts which can be used. For example, a very inexpensive option would be to force fit a mushroom cap (acting as the nut) onto the end of a rebar rod (acting as the bolt) to accomplish the same end. Another option would be to employ a pressure device with a manual release to grip a rebar rod or a bolt. In the preferred embodiment, field insert 210 is made of a durable, flexible and resilient elastomeric material. Molded natural rubber is one suitable material meeting the requirements. Molded synthetic rubber is another material meeting the requirements. Persons skilled in the art will be familiar with additional materials meeting the requirements described above. The securement device is accessible without the need to move the panel and therefore, the insert can be installed, removed, reinstalled or replaced without the need to move the panel.

Field insert 210 has field insert access hole cap 230 which is placed into field insert access hole 256 after field bolt 250 and field nut 232 have been properly tightened. In the preferred embodiment, field insert access hole 256 is wider at the top than at the bottom so that when field insert access hole cap 230 is placed in field insert access hole 256, field insert access hole cap 230 will not go all the way into field insert access hole 256. Persons skilled in the art will be familiar with a wide variety of ways of engaging field insert access hole cap 230 in field insert access hole 256. For example, field insert access hole cap 230 could have an outwardly protruding ring for engaging an indent in field access hole 256. Field insert top surface 222 is horizontal and level with field panel top surface 273. Field insert top surface 222 may have a pattern molded into the surface.

Field insert top surface 222 ends at field insert top surface edge 211 and extends downward into field insert curve 213, then extends forward to field insert face 216. Field insert face 216 is a generally flat surface which preferably contacts rail 10 but does not necessarily contact rail 10 due to track structural tolerances. Contact of field insert face 216 with rail 10 is not necessary because contact need only occur if field panel 270 moves toward rail 10. As long as field insert face 216 extends under the ball of rail 10, field insert 210 will form a shield protecting the track and ballast below. Likewise, it is not necessary for field insert top surface edge 211 to contact rail 10. Contact of field insert face 216 or field insert top surface edge 211 with rail 10 is not necessary to perform a function for which field insert 210 is intended. Field insert face 216 may contact rail 10 and field insert top surface edge 211 may contact rail 10 or neither may contact rail 10 or one or the other may contact rail 10. The purpose of field insert 210 is to reduce the migration of liquid or solid materials to the rail base area of the clips, ties, and ballast, and, in certain applications, to stabilize field panel 170 movement toward rail 10. Field insert bottom surface 217 is flat and horizontal. Field insert top section 222, field insert first corner 211, field insert face 216, and field insert bottom surface 217 define field insert arm 219. FIG. 4 depicts an indent in field insert 210 for receiving field angle 240. However, the indent is not necessary and field insert 210 can be shaped to extend straight out from field angle 240.

Figure 5:
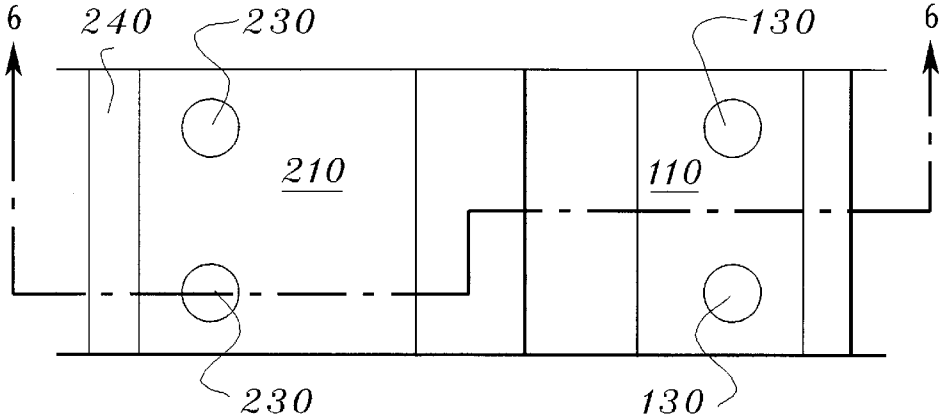
FIG. 5 depicts a cut line from a top view to show the cross section of FIG. 5

FIG. 5 shows cut line 6—6. On the left cut line 6—6 runs through field insert access hole 230 and on the right side cut line 6—6 does not run through any field insert hole.

Figure 6:
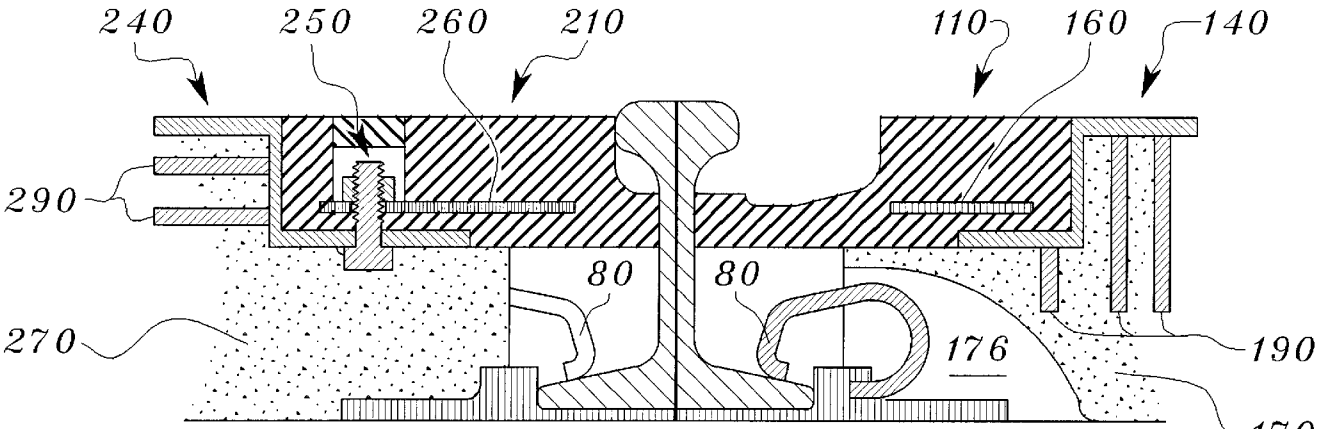
FIG. 6 depicts a cross sectional view along the cut line of FIG. 4 showing an alternative panel structure

FIG. 6 shows the cut line displayed in FIG. 5. FIG. 6 shows an alternative embodiment of the apparatus where gauge panel 170 is constructed so that gauge panel 170 has rail retaining device cavity 176 and field panel 240 has a similar rail retaining device cavity which is not shown in FIG. 6. The reason for the staggered cut line in FIG. 6 is to show that rail retaining device cavities for rail retention clips 80 are staggered so that gauge bolt 150 (cannot be seen in FIG. 6) will not be placed in gauge panel 170 above rail retention clip cavity 176 and so that field bolt 250 will not be placed in field panel 270 above railroad clip 80.

FIG. 6 also shows field angle 240 secured to horizontal rods 290. Gauge angle 140 is secured to gauge panel 110 by vertical rods 190. Any combination of horizontal and vertical rods may be utilized. In the preferred embodiment, vertical rods 190 and horizontal rods 290 are spaced 12" center to center and are welded to the rebar rods (not shown) embedded in gauge panel 170 and field panel 270. Persons skilled in the art will be familiar with a wide variety of ways in which to secure gauge angle 140 and field angle 240 to gauge panel 170 and field panel 270 respectively. The spacing of the rods as well as the number of rods can be varied to maximize the strength of the unit.

Figure 7:
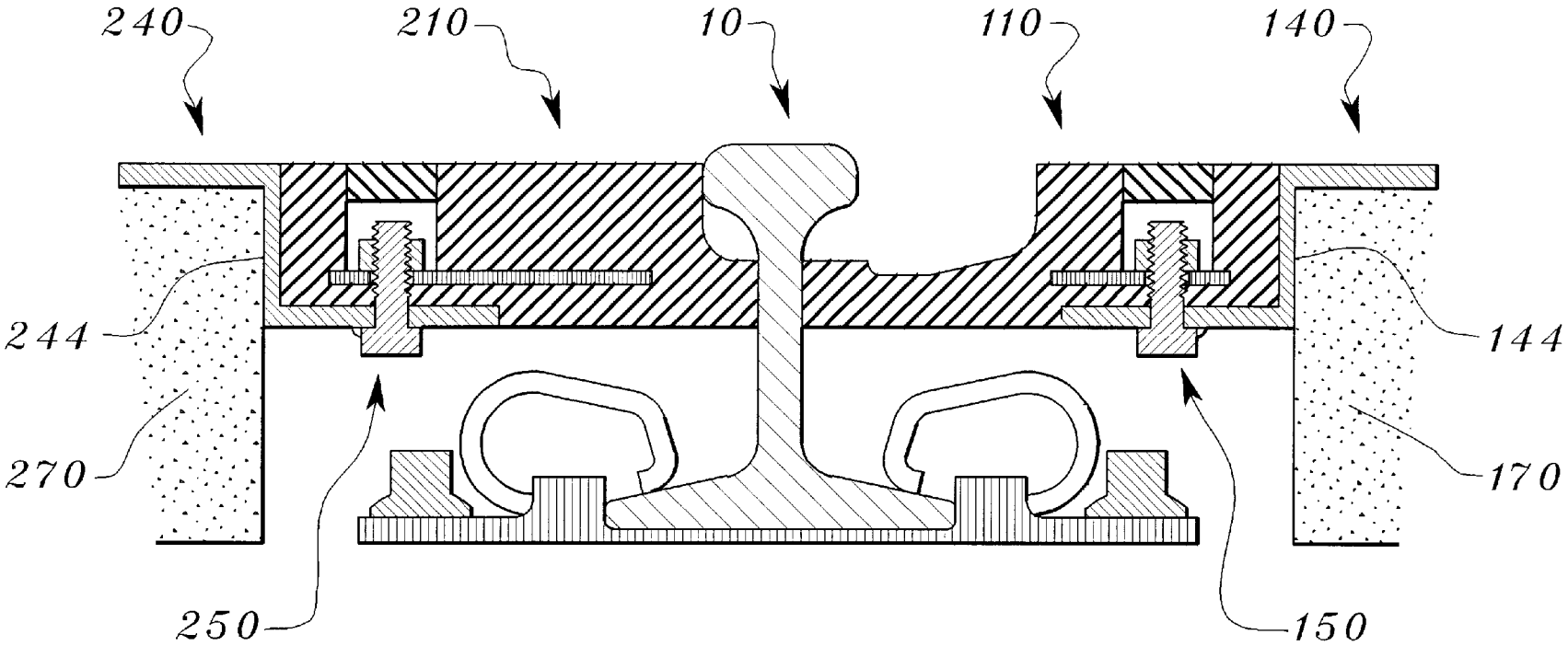
FIG. 7 depicts an alternative panel structure.

FIG. 7 shows an alternate embodiment of gauge panel 170 and field panel 270 in which gauge panel 170 extends down in a vertical direction from gauge angle vertical section 144 and gauge angle horizontal section extends outward away from gauge panel 170 providing support for gauge insert 110. Likewise, field panel 270 extends down in a vertical direction from field angle vertical section 244 and field angle horizontal section extends outward away from field panel 270 providing support for field insert 210.

Figure 8:
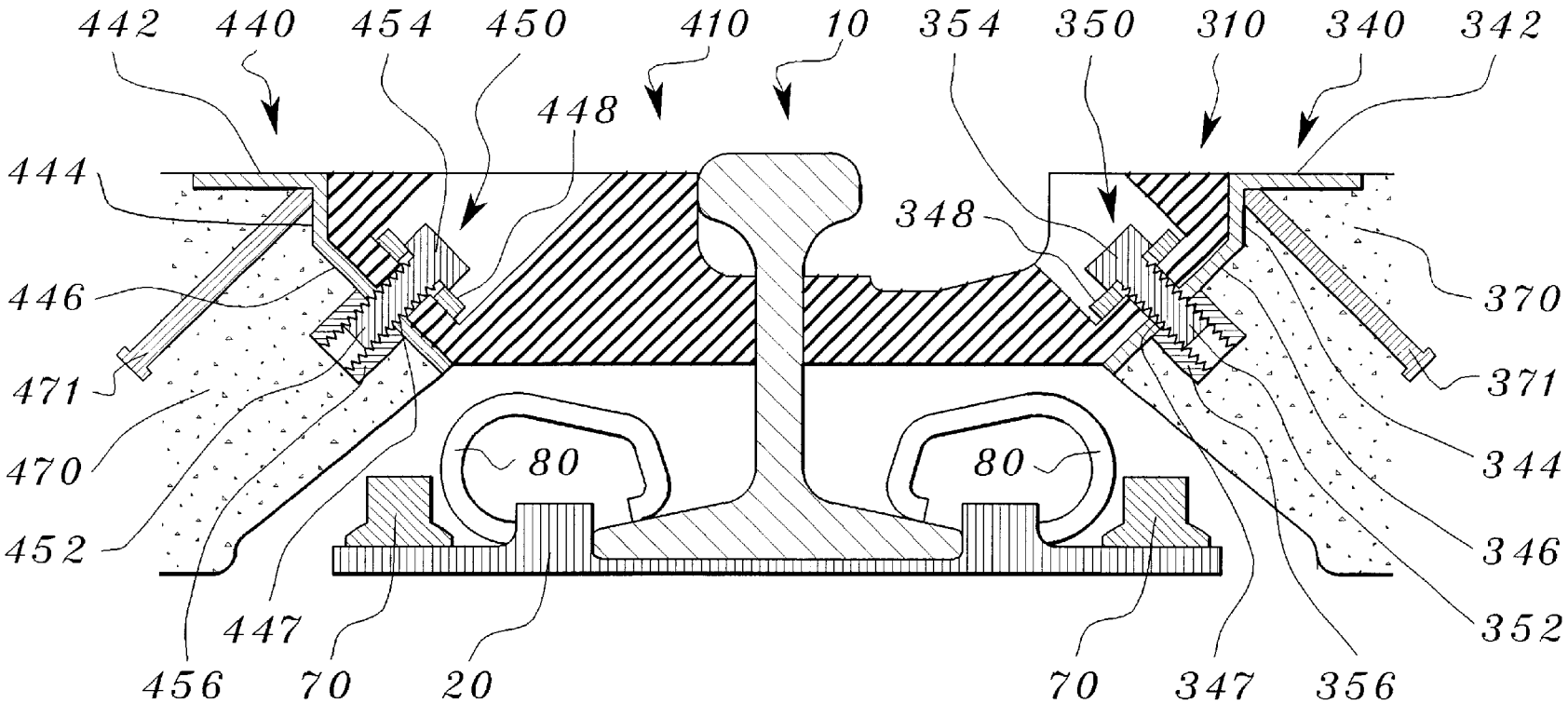
FIG. 8 depicts an alternative embodiment of the system.

FIG. 8 shows an alternate embodiment of the invention. In FIG. 8, gauge angle 348 has gauge angle horizontal section 342, gauge angle vertical section 344, and gauge angle sloped section 346. Likewise, field angle 440 has a field angle horizontal section 442, a field angle vertical section 444 and a field angle sloped section 446. Gauge angle sloped section hole 347 receives gauge bolt 354. Field angle sloped section hole 447 receives field bolt 450. Gauge bolt 350 is inserted through gauge washer 348 and gauge angle sloped section hole 347 and rotated to engage gauge threaded receiver 356. Field bolt 450 is inserted through field washer 448 and field angle sloped section hole 447 and rotated to engage field threaded receiver 456. Persons of ordinary skill in the art will know that the use of gauge bolts 350 and field bolts 450 could be reversed and gauge bolt head 354 and field bolt head 454 could be welded beneath gauge angle sloped section 346 and field angle sloped section 446 respectively. Gauge threaded receiver 356 and field threaded receiver 456 could be replaced by gauge nut 232 (as shown in FIG. 2) and field nut 232 (as shown in FIG. 4) respectively. Alternatively, gauge angle sloped section hole 347 and field angle sloped section 447 could be threaded for receiving gauge bolt 350 and field bolt 450 respectively. Gauge angle 340 is fixedly attached to gauge panel 370 by gauge angle rod 371. Field angle 440 is fixedly attached to field panel 470 by field angle rod 471. In the embodiment disclosed, gauge angle rod 371 and field angle rod 471 are spaced 12" center to center and may be further attached to horizontal or vertical rebar rods in the concrete of field panel 470 and gauge panel 370. The preferred method of attaching gauge angle rod 371 to gauge angle 370 and field angle rod 471 to field angle 470 is by welding. Moreover, the preferred method of attaching gauge angle rod 371 and field angle rod 471 to rebar rods (not shown) in gauge panel 370 and field panel 470 is by welding: Persons skilled in the art are familiar with a variety of methods and devices for securing anchor rods to metal plates such as gauge angle 340 and field angle 440 and also for securing anchor rods to rebar rods embedded in concrete.

One advantage of the embodiment shown in FIG. 8 is that there is no stabilizing plate. Therefore, in addition to the materials discussed above, extruded rubber may also be usable as a material for gauge insert 310 and field insert 410. Moreover, gauge washer 348 and field washer 448 can allow for dispensing with gauge slope angle 340 and field slope angle 440 thereby decreasing manufacturing costs.

Figure 9:
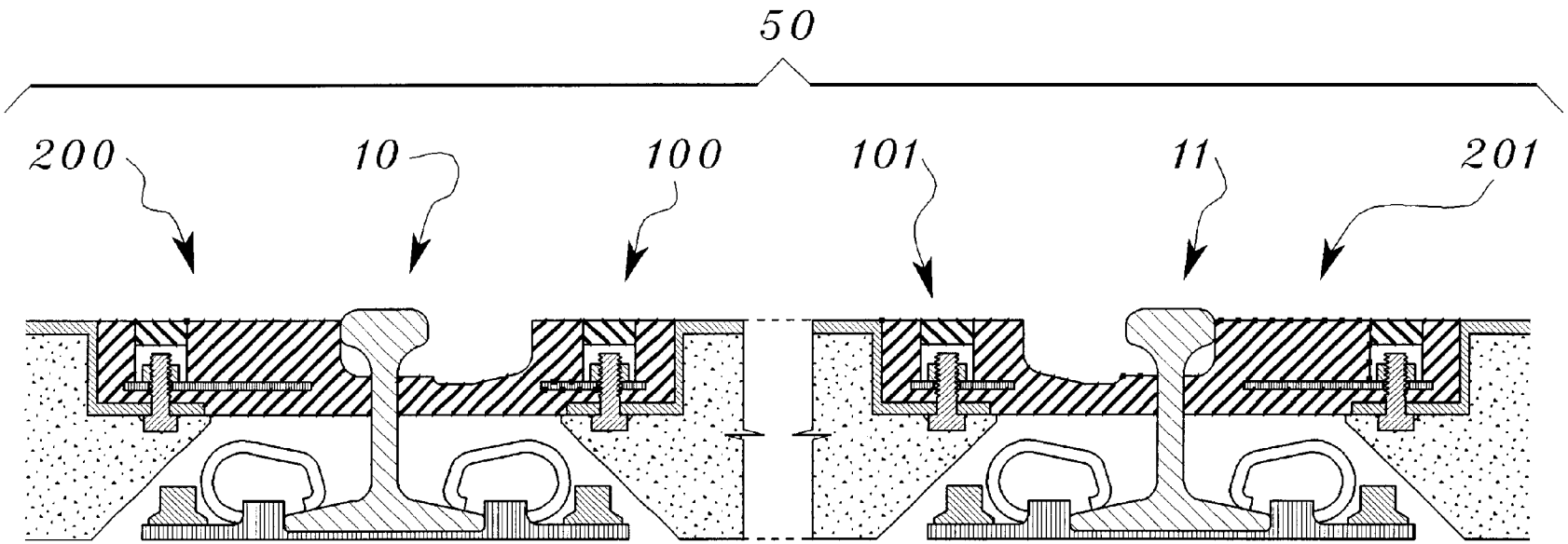
FIG. 9 depicts the system applied to two rails of a single track.

FIG. 9 shows apparatus 50 employed to embed two rails. Apparatus 50 is shown with the center section foreshortened. Field panel 200 for rail 10 mirrors field panel 201 for rail 11. Gauge panel 100 for rail 10 mirrors gauge panel 101 for rail 11.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

What is claimed:

1. An apparatus for an embedded railway system comprising:

at least one insert removably affixed to a surrounding surface by at least one securement device;

a plate located within the insert;

wherein the plate interacts with the securement device to affix the insert. to the surrounding surface; and wherein the insert can be installed, removed, replaced or reinstalled without the need to move the surrounding surface from its position within the embedded railway system and without the need to force fit or substantially deform any portion of the insert.

2. An apparatus for an embedded railway system comprising:

at least one insert removably affixed to a surrounding surface by at least one securement device;

a plate located within the insert;

wherein the plate interacts with the securement device to affix the insert to the surrounding surface; and wherein the insert can be removed, replaced or reinstalled without the need to move the surrounding surface from its position within the embedded railway system.

3. The apparatus of claim 2 wherein the insert is elastomeric.

4. The apparatus of claim 2 wherein the securement device comprises a nut and a bolt.

5. The apparatus of claim 2 wherein the surrounding surface comprises at least one panel.

6. An apparatus for an embedded railway system comprising:

at least one insert removably affixed to a surrounding surface by at least one securement device;

a plate located within the insert;

wherein the plate interacts with the securement device to affix the insert to the surrounding surface; and wherein the insert can be installed, removed, replaced or reinstalled without the need to move the surrounding surface from its position within the embedded railway system and without the need to force fit the insert.

7. An apparatus for an embedded railway system comprising:

at least one insert removably affixed to a surrounding surface by at least one securement device;

a plate located within the insert;

wherein the plate interacts with the securement device to affix the insert to the surrounding surface; and wherein the insert can be installed, removed, replaced and reinstalled without the need to move the surrounding surface from its position within the embedded railway system.

8. An apparatus for embedding a railway track in a surrounding surface comprising:

an elastomeric insert fixedly and removably engaged to a panel;

a plate located within the insert;

wherein the plate interacts with the securement device to affix the insert to the surrounding surface; and wherein the insert may be installed, removed, replaced and reinstalled without moving the panel from its position within the embedded railway system.

9. The panel of claim 8 further comprising at least one angle.

10. The apparatus of claim 8 further comprising at least one securement device.

11. The apparatus of claim 8 further comprising at least one securement device cap.

12. The insert of claim 8 further comprising a plate.

13. An apparatus for embedding a railway track comprising:

a field panel;

a field insert fixedly and removably engaged to said field panel;

a field plate located within the field insert;

a gauge panel;

a gauge insert fixedly and removably engaged to said gauge panel;

a gauge plate located within the gauge insert;

wherein the field plate interacts with a field securement device to affix the field insert to the field panel;

wherein the gauge plate interacts with a gauge securement device to affix the gauge insert to the gauge panel;

wherein the field insert may be installed, removed, replaced or reinstalled without moving the field panel from its position within the surrounding surface; and wherein the gauge insert may be installed, removed, replaced or reinstalled without moving the gauge panel from its position within the surrounding surface.

14. The field panel of claim 13 further comprising the field insert having at least one hole for receiving the at least one field securement device.

15. The gauge panel of claim 13 further comprising the gauge insert having at least one hole for receiving the at least one gauge securement device.

16. An apparatus for embedding a railway track in a surrounding surface comprising:

a field panel comprising:

at least one field securement device;

a field insert having at least one hole for receiving at least one field securement device, a field insert rail end and a first insert panel end;

a field insert plate located within the field insert having at least one hole for receiving the at least one field securement device;

a gauge panel comprising;

at least one gauge securement device, a gauge insert having at least one hole for receiving at least one gauge securement device, a gauge insert plate located within the gauge insert having at least one hole for receiving the at least one gauge securement device, a gauge insert rail end and a gauge insert panel end;

the at least one gauge securement device having a gauge securement device first end and a gauge securement device second end fixedly engaged to the gauge panel;

at least one gauge securement device cap having a hole for receiving the at least one gauge securement device first end;

the at least one field securement device having a field securement device first end and a field securement device second end fixedly engaged to the field panel;

at least one field securement device cap having a hole for receiving at least one field securement device first end;

wherein the field insert plate interacts with a field securement device to affix the field insert to the field panel;

wherein the gauge insert plate interacts with a gauge securement device to affix the gauge insert to the gauge panel;

wherein at least one gauge securement device is aligned with at least one hole for receiving the at least one gauge securement device;

wherein when the at least one gauge securement device cap is removably engaged to the gauge securement device first end, the gauge insert is engaged to the gauge panel;

wherein the at least one field securement device is aligned with at least one hole for receiving the at least one field securement device;

wherein, when the at least one field securement device cap is removably engaged to the field securement device first end, the field insert is engaged to the field panel;

wherein the field insert may be installed, removed, replaced and reinstalled without moving the field panel from its position within the surrounding surface; and wherein the gauge insert may be installed, removed, replaced and reinstalled without moving the gauge panel from its position within the surrounding surface.

* * * * *